United States Patent [19]

Hartgrave

[11] 4,407,083

[45] Oct. 4, 1983

[54] ANIMATED FIGURE AMUSEMENT DEVICE

[76] Inventor: Jimmy D. Hartgrave, 320 W. 17th, Apt. 108, Tulsa, Okla. 74119

[21] Appl. No.: 355,854

[22] Filed: Mar. 8, 1982

[51] Int. Cl.[3] ..... G09F 19/08

[52] U.S. Cl. ..... 40/414; 46/139

[58] Field of Search ..... 46/139; 40/414, 411, 40/420

[56] References Cited

U.S. PATENT DOCUMENTS

| | | | |
|---|---|---|---|
| 832,196 | 10/1906 | Husted | 40/420 |
| 852,388 | 4/1907 | Keefer | 46/139 |
| 862,625 | 8/1907 | Field | 40/414 |
| 1,307,121 | 6/1919 | Foster | 40/420 |
| 2,334,212 | 11/1943 | Monkers | 40/414 |
| 2,467,040 | 4/1949 | King | 40/420 |
| 4,123,865 | 11/1978 | Pearson | 40/414 |

*Primary Examiner*—Gene Mancene
*Assistant Examiner*—Wenceslao J. Contreras
*Attorney, Agent, or Firm*—Head, Johnson & Stevenson

[57] ABSTRACT

An action-type decorator item comprising a housing having two compartments, the first of the compartments being enclosed by opaque sidewalls for obscuring viewing of the interior thereof and the second of the compartments being encased by transparent walls for facilitating viewing the interior thereof, a figurine suspended within the second compartment and operably connected with a power supply mounted in the first compartment, the figurine being activated by the power supply to achieve an overall action of the figurine simulating reality of movement found in nature.

7 Claims, 3 Drawing Figures

ANIMATED FIGURE AMUSEMENT DEVICE

BACKGROUND OF THE INVENTION

1. Field of the Invention

This invention relates to improvements in amusement devices and more particularly, but not by way of limitation, to an action-type amusement device.

2. Description of the Prior Art

There has been an increasing interest and use of action-type amusement devices, such as mobiles wherein delicately balanced elements are suspended whereby the elements move in an eyecatching seemingly perpetual motion manner. Other such devices have been developed wherein stationary displays are provided with movable figurines, or the like, such as dancing figures placed atop a music box. Still other animated devices are available, such as those shown in the Stubbins U.S. Pat. No. 2,405,376 and the Chester et al U.S. Pat. No. 1,547,899. The Stubbins patent shows an advertising display device comprisint an endless band operated from a motor, or the like, and the band carries figures or words which move endlessly across a display area or stage. The Chester et al patent relates to an animated figure wherein the legs of the figure are designed to be moved with relation to the torso of the body in such a manner as to simulate the natural movements of the animal or human being. These devices are charming and amusing, but there is a certain lack of overall realism in the renditions.

SUMMARY OF THE INVENTION

The present invention contemplates a novel animated or action-type amusement device particularly designed and constructed to achieve an overall aura of realism of the action taking place within a stationary display case. The novel device comprises a housing having an internal wall or partition providing forward and rear internal compartments therefor. The rear compartment is enclosed or encased in opaque sidewalls for shutting of the view into the compartment whereas the forward compartment is provided with a transparent front and top to provide a substantially unrestricted view of the interior thereof. The rear compartment contains the operational components which transmit action to a figurine suspended with in the forward compartment for creating a normal appearing movement for the figurine. In addition, the interior sidewalls and back wall of the forward compartment are decorated in a manner particularly selected for blending with the suspended figurine to enhance the overall natural appearance for the action thereof. For example, assuming that the suspended figurine is representative of a jogger, the surrounding decor may be of an outdoor scene including a path along which the jogger may appear to be moving. The legs of the jogger are affixed to the torso of the jogger in such a manner that the legs may be moved by the operational components mounted in the rear compartment whereby the entire figurine appears to be moving in coincidence with the movement of the legs such as if the figurine were a live jogger. The overall effect is extremely entertaining in that the jogger appears to be jogging along the path without actually moving from his suspended position within the display stage or area. This is particularly accented by the coordination between the decor of the forward compartment and the selected action of the suspended figurine therein, and the fact that the rear compartment encases the operational components in such a manner that the figurine appears to be moving without the benefit of auxiliary equipment. The novel amusement device is simple and efficient in operation and economical and durable in construction.

DETAILED DESCRIPTION OF THE PREFERRED EMBODIMENT

Figure 1:
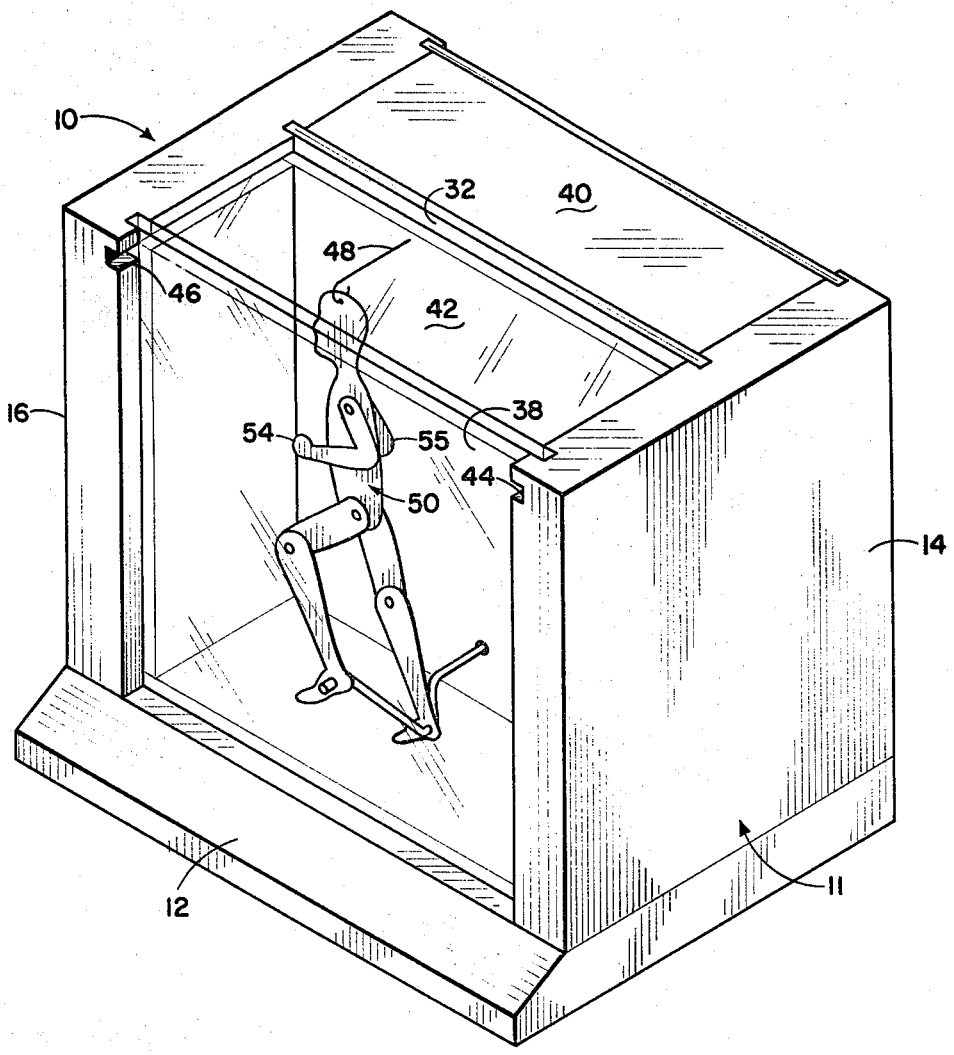
FIG. 1 is a perspective view of an action-type amusement device embodying the invention.
Figure 2:
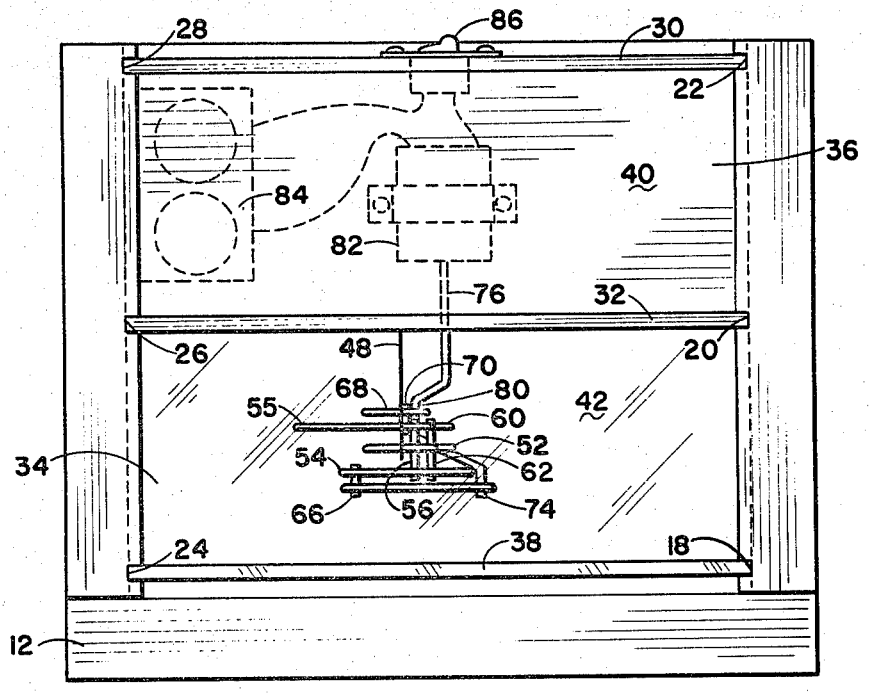
FIG. 2 is a top view of an action-type amusement device embodying the invention.
Figure 3:
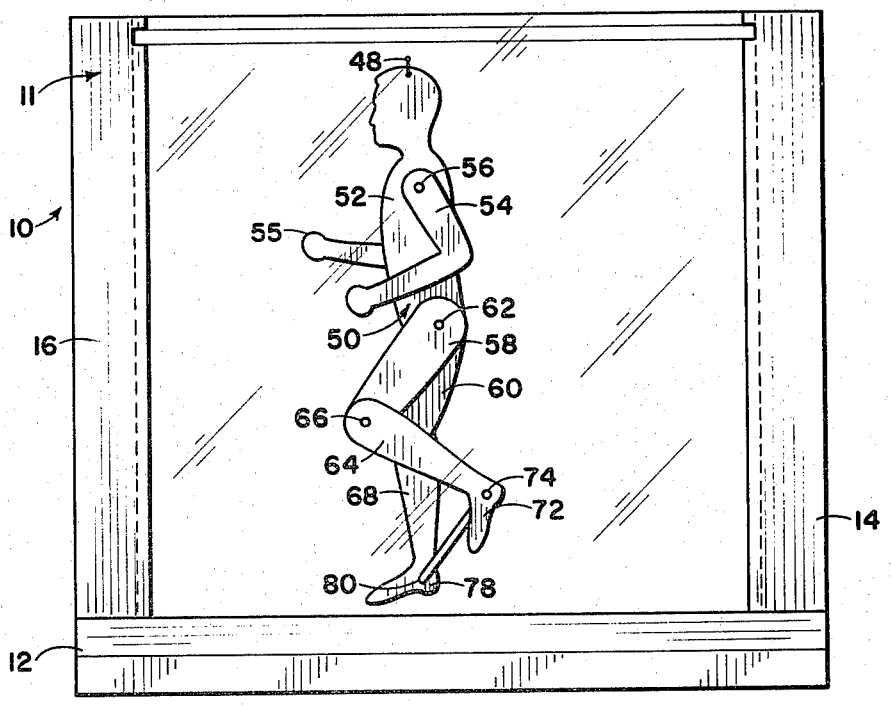
FIG. 3 is a front elevational view of the action-type amusement device shown in FIG. 2.

Referring to the drawings in detail, reference character 10 generally indicates an amusement device comprising a housing 11 having bottom plate 12 having a pair of spaced and oppositely disposed sidewalls 14 and 16 extending upwardly therefrom as viewed in the drawings. The inner surface of the sidewall 14 may be provided with three substantially mutually parallel spaced grooves 18, 20 and 22 extending from the bottom plate 12 to the upper edge thereof. The inner surface of the sidewall 16 may be provided with three similar spaced grooves 24, 26 and 28 in substantial alignment with the grooves 18, 20 and 22 as particularly shown in FIGS. 2 and 3. An opaque plate member 30 rests on the upper surface of the bottom plate 12 and has the opposite edges thereof engaged with the grooves 22 and 28 to provide a back plate for the housing 11. A second opaque plate member 32 rests on the upper surface of the bottom plate 12 and has the opposite edges thereof engaged with the grooves 20 and 26, and forms a substantially centrally disposed partition for the housing 10 which separates the housing into a forward compartment 34 and a rear compartment 36. A transparent plate 38 rests on the upper surface of the bottom plate 12 and has the opposite edges thereof engaged in the grooves 18 and 24 to provide a transparent front for the compartment 34. In addition, an opaque top plate 40 is secured between the sidewalls 14 and 16 to enclose the chamber 36, and a transparent top member 42 is interposed between the sidewalls 14 and 16 to enclose the chamber 34. The transparent top plate 42 may be secured in place in any suitable manner, and as shown herein, the opposite edges thereof are disposed in transversely extending aligned grooves 44 and 46 provided in the sidewalls 14 and 16, with the top member 42 being disposed rearwardly of the front plate 38 and extending into abutment with the partition 32.

A yieldable support member 48 is secured to the partition 32 in any suitable manner and extends outwardly therefrom into the interior of the chamber 34 for yieldably supporting a figurine 50 therefrom. Whereas the figurine 50 shown herein is representative of a man, it is to be understood that substantially any desired animal may be similarly represented by the figurine. The man 50 comprises a torso and head portion 52 loosely secured to the support member 48 in any suitable manner whereby the head and torso may move somewhat freely during operation of the device 10 as will be hereinafter set forth. Left and right arms 54 and 55 are secured to the torso 52 by means of a suitable pivot shaft 56 which extends transversely through the torso 52. Each arm 54 and 55 is spaced slightly from the respective face or side of the torso 52 thus providing for freedom of movement therebetween.

Left and right thighs 58 and 60 are similarly secured to the lower portion of the torso 52 by a suitable shaft 62 which extends transversely through the torso 52. The thighs 58 and 60 are spaced slightly from the respective face or side of the torso 52 in a similar manner as the arms 54 and 55, thus providing for freedom of movement between the thighs and torso. A left leg 64 is secured to the lower end of the thigh 58 by a transversely extending pivot shaft 66, with the leg 64 being spaced slightly from the thigh 58 to permit freedom of movement therebetween. Similarly, a right leg 68 is secured to the lower end of the thigh 60 by a transversely extending pivot shaft 70 and is slightly spaced therefrom to provide for freedom of movement therebetween.

The heel portion 72 of the left leg 64 is pivotally secured to the outer end 74 of a crank shaft 76 and is movable simultaneously therewith. The heel portion 78 of the right leg 68 is similarly pivotally secured to an off-set or crank portion 80 of the crank shaft 76. The crank shaft 76 extends through an aperture (not shown) in the partition 32 and is operably connected with a suitable power supply, such as an electric motor 82 for rotation thereby, as is well known. The motor 82 may be mounted within the compartment 36 in any suitable manner, such as by bolting thereof to the bottom plate 12, and is electrically connected with a suitable power source, such as a battery pack means 84. An on-off switch means 86 may be installed on the outer surface of the housing 11, such as on the outer surface of the back plate 30, and is in operable connection between the motor 82 and battery pack 84 to provide for selective activation of the motor 82 as is well known.

Whereas an electric motor and associated battery pack 84 are shown herein, it is to be noted that a solar power system may be provided for the compartment 36, if desired. There is no intention of limiting the power supply to that specifically shown herein.

In operation, the switch means 86 may be moved to the "on" position whereby power is directed from the battery pack 84 to the motor 82 for actuation thereof. This transmits rotation to the crank shaft 76 whereby the outer end 74 and crank portion 80 thereof are simultaneously rotated about the longitudinal axis of the crank shaft. As the crank portion 80 and outer end 74 of the crank shaft 76 rotate, the heels 78 and 72, respectively, move simultaneously therewith, thus pivoting the legs 68 and 64 about the respective pivot shafts 70 and 66. This movement, in turn, causes the thighs 60 and 58 to pivot about the pivot shaft 62, thus resulting in a movement of the legs and thighs in a manner closely resembling or simulating the movement of a runner or jogger. Of course, the overall movement of the legs and thighs imparts a certain to and fro movement to the torso 52 about the connection thereof with the support member 48. Also, the arms 54 and 55 pivot about the shaft 56 in a to and fro action closely approximating the action of the arm movements of a jogger. As long as the motor 82 is activated, the figurine 50 as viewed from exteriorly of the compartment 34 appears to be running or jogging. Of course, it is desirable to provide a suitable or complementary decoration on the inner periphery of the compartment 34 for lending a reality to the overall scene viewed in the compartment.

As hereinbefore set forth, it may be desirable to provide other types of animals, or figurines of men or women performing other movements, and the invention is not limited to a representation of a runner or jogger.

From the foregoing, it will be apparent that the present invention provides a novel action-type decorator item wherein a movable figurine is suspended within a visible compartment, but in a manner wherein the suspension of the figurine is essentially invisible or unnoticeable. The power supply for achieving the motion for the suspended figurine is mounted in an enclosed compartment for obscuring any viewing thereof, thus lending an overall realistic atmosphere upon the viewing of the moving figurine.

Whereas the present invention has been described in particular relation to the drawings attached hereto, it should be understood that other and further modifications, apart from those shown or suggested herein, may be made within the spirit and scope of this invention.

What is claimed is:

1. An action-type decorator item comprising housing means, first and second compartments provided in the housing means, power supply means mounted within the first of said compartments, movable figurine means suspended in the second of said compartments, means operably connected between the power supply means and figurine means for transmitting motion to the figurine means to achieve a life-like movement therefor, the figurine means comprising a body simulating an animal having at least the legs thereof pivotally secured to the torso thereof whereby the action of the figurine simulates a natural movement, the legs being operably connected with the power supply for movement thereby, and including crank shaft means operably connected between the power supply means and legs for transmitting said movement thereto.

2. An action-type decorator item as set forth in claim 1 wherein the first of said compartments is enclosed by opaque sidewalls for precluding viewing of the interior thereof, and the second of said compartments is enclosed by at least one transparent sidewall permitting viewing of the figurine therethrough.

3. An action-type decorator item as set forth in claim 1 wherein the compartments are separated by opaque partition means precluding viewing of the power supply means while viewing the figurine.

4. An action-type decorator item as set forth in claim 1 and including yieldable support means extending into the second compartment for suspending the figurine therein.

5. An action-type decorator item as set forth in claim 1 wherein the animal is a human body.

6. An action-type decorator item as set forth in claim 5 wherein the human being figurine is provided with a torso having left and right arms pivotally secured thereto and left and right legs pivotally secured thereto, the left and right legs being operably connected with the power supply for movement thereby.

7. An action-type decorator item as set forth in claim 6 wherein the left and right legs each comprise a thigh pivotally secured to the torso and a lower leg portion pivotally secured to the thigh, the lower leg portion being operably connected with the power supply for movement thereby.

* * * * *